US008123450B2

(12) United States Patent
Müller

(10) Patent No.: US 8,123,450 B2
(45) Date of Patent: Feb. 28, 2012

(54) APPARATUS FOR PRESSING A BOOK CASING AGAINST THE ADHESIVE-COATED OUTSIDE SURFACES OF A BOOK BLOCK TO BE ENCASED IN A CASING-IN MACHINE

(75) Inventor: Hans Müller, Lauda-Konigshofen (DE)

(73) Assignee: Mueller Martini Holding AG, Hergiswil (CH)

( * ) Notice: Subject to any disclaimer, the term of this patent is extended or adjusted under 35 U.S.C. 154(b) by 1193 days.

(21) Appl. No.: 11/585,989

(22) Filed: Oct. 25, 2006

(65) Prior Publication Data

US 2007/0092357 A1 Apr. 26, 2007

(30) Foreign Application Priority Data

Oct. 25, 2005 (EP) ..... 05405603
Oct. 25, 2005 (EP) ..... 05405604

(51) Int. Cl.

| | |
|---|---|
| ***B42C 11/00*** | (2006.01) |
| ***B42C 9/00*** | (2006.01) |
| ***B42C 11/02*** | (2006.01) |
| ***B42C 11/04*** | (2006.01) |
| ***B42C 13/00*** | (2006.01) |

(52) U.S. Cl. ..... 412/22; 412/4; 412/8; 412/9; 412/19; 412/21

(58) Field of Classification Search ..... 270/52.26, 270/58.08; 412/4, 8, 9, 19, 21, 22; *B42B 4/00; B42C 1/12, 3/00, 11/00, 11/04, 19/00, 19/04; B42H 5/30, 37/04, 45/00, 45/04*

See application file for complete search history.

(56) References Cited

U.S. PATENT DOCUMENTS

| | | | | |
|---|---|---|---|---|
| 1,870,700 | A | 8/1932 | Webern et al. | |
| 2,549,890 | A | 4/1951 | Burls | |
| 4,732,521 | A | 3/1988 | Kolkhorst | |
| 4,904,138 | A * | 2/1990 | Champeaux et al. | 412/8 |

(Continued)

FOREIGN PATENT DOCUMENTS

DE 15 36 505 A 2/1970

(Continued)

OTHER PUBLICATIONS

European Search Report dated Apr. 12, 2006.

(Continued)

*Primary Examiner* — Dana Ross
*Assistant Examiner* — Justin Lewis
(74) *Attorney, Agent, or Firm* — Venable LLP; Robert Kinberg; Leigh D. Thelen

(57) ABSTRACT

A saddle plate is disposed on a circulating conveyor which moves the saddle plate vertically upward. The saddle plate is arranged to receive a book block in a straddle like fashion with first and second adhesive-coated outside surfaces of book block being exposed. A pressing-on device operates synchronously with the circulating conveyor and includes two pressing-on rollers. Each roller presses a respective first or second book cover of a book casing against a respective first or second adhesive-coated outside surface. First and second drive motors are operatively coupled, respectively, with the pressing-on device and circulating conveyor. A drive control unit, operatively coupled to the first and second drives, controls the first and second drives and controllably links one to another. At least the first drive includes a controllable drive element.

19 Claims, 5 Drawing Sheets

U.S. PATENT DOCUMENTS

| | | | | |
|---|---|---|---|---|
| 6,186,721 | B1 * | 2/2001 | Ganter | 412/22 |
| 6,352,252 | B1 | 3/2002 | Schmucker et al. | |
| 6,450,749 | B1 | 9/2002 | Ganter | |
| 2004/0239026 | A1 * | 12/2004 | Nagai | 270/58.08 |

FOREIGN PATENT DOCUMENTS

| | | | |
|---|---|---|---|
| DE | 20 12 356 | A | 10/1971 |
| DE | 75 03 902 | U | 6/1975 |
| DE | 37 13 896 | A | 10/1987 |
| DE | 88 16 033 | U | 2/1989 |
| DE | 199 55 993 | A | 5/2001 |
| DE | 101 10 319 | A | 9/2002 |
| EP | 0 198 201 | A | 10/1986 |
| EP | 1 072 435 | A | 1/2001 |
| EP | 1 072 436 | A | 1/2001 |
| GB | 164 167 | A | 6/1921 |
| GB | 776 439 | A | 6/1957 |
| JP | 51104464 | A | 9/1976 |

OTHER PUBLICATIONS

D. Liebau et al., "Industrielle Buchbinder," [Industrial Bookbinders], Publishing House Verlag Beruf + Schule, Itzehoe, Germany, pp. 335-337, Copyright date 1997.

European Search Report with English translation dated Jan. 6, 2006, issued in European Application No. 05 405603.1.

Office Action dated Jun. 2, 2009, issued in related U.S. Appl. No. 11/586,005.

* cited by examiner

APPARATUS FOR PRESSING A BOOK CASING AGAINST THE ADHESIVE-COATED OUTSIDE SURFACES OF A BOOK BLOCK TO BE ENCASED IN A CASING-IN MACHINE

CROSS-REFERENCE TO RELATED APPLICATIONS

This application claims the priority of European Patent Application No. 05405604.9, filed on Oct. 25, 2005, and European Patent Application No. 05405603.1, filed on Oct. 25, 2005. This application is additionally related to co-owned and concurrently filed U.S. patent application Ser. No. 11/586,005, entitled "Apparatus For Applying Adhesive To The Outside Surfaces Of A Book Block To Be Encased In A Book Casing Inside A Casing-In Machine." The contents of each of the foregoing applications is incorporated herein by reference in their entirety.

BACKGROUND

The invention relates to an apparatus for pressing a flattened book casing against the adhesive-coated outside surfaces of a book block to be encased in a casing-in machine. An apparatus comprises two pressing-on rollers that are positioned opposite each other in a pressing-on region of a pressing-on device, which is driven synchronously with a conveyor, wherein these rollers respectively press one book cover of the book casing against one adhesive-coated outside surface of a book block, positioned on a vertically upward moving saddle plate of a circulating conveyor.

The visual attractiveness of a book depends, in part, on the quality of the work when encasing a book block in a book casing. For that reason, a precise joining of book block and book casing is therefore necessary not only for high-quality books, but also to ensure that the outside edges of both parts extend visibly parallel to each other and that a uniform spacing is visible between the parallel outside edges. In addition, the book covers of a book casing must rest with the complete surface and without raised areas on the book block and/or must be glued on the inside to the end papers, so that no folds can form and the outside edges extend parallel to each other, wherein the back insert or the back lining fits against the book block spine of a closed book.

The typical steps of this process are described, for example, in European Patent Document 1 072 436 A1 (Jan. 31, 2001). However, the described process has the disadvantage that the movement course for the pressing-on device is fixedly determined by a mechanically acting control cam of a control element and can be changed only if the control element is replaced. In practical operations, a single control element is therefore used which is suitable for formats up to the largest one. Furthermore, a joint electric motor is used for driving the book block conveyor and the pressing-on device, which results in long movement paths and/or high acceleration forces for the pressing-on device, even with smaller book formats.

Also, of high importance is the distance traveled by the pressing-on device along the synchronizing section, between the book block spine and the back insert in a state where the book casing rests unsupported on a casing support and/or the pressing-down rollers approximately make contact with the surface of the book casing (at the so-called attachment point). The attachment point is primarily determined by the thickness and/or the cross-sectional shape of a book block spine.

Until now, the length of the synchronizing section was kept constant for all book formats.

If the pressing-on device is located on the synchronizing section, the pressing-on rollers initially lift off the book casing and then return to it once the pressing-on device reaches the end of the synchronizing section. At the start of the production, attention must be paid to ensure that the movement of the pressing-on rollers on the pressing-on device is adapted to the supplied book casing, corresponding to the desired fold and/or joint of a book. It is therefore necessary to ensure at the start of the production that the attachment point for the pressing-on device can be set and/or changed by adjusting the control element. This operation has until now been possible only if the apparatus is stopped, for example by adjusting the mechanically effective control element manually or with a specialized gear.

SUMMARY

It is an object of the invention to provide an apparatus of the above-described type, which allows adapting the pressing-on device optimally to any type of book block thickness during the operation.

It is another object to provide an apparatus of the above type wherein the attachment point for the pressing-on movement can be precisely determined and changed, the format-dependent lift can be determined, the dwell time for the pressing-on device during the pressing-on operation can be optionally adjusted, and the speed of the pressing-on device on the synchronizing section can be adapted.

The above and other objects are accomplished by provision of an apparatus for pressing a flattened book casing having first and second book covers against first and second adhesive-coated outside surfaces of a book block to be encased in a book casing in a casing-in machine, wherein, according to one embodiment, the apparatus comprises: a circulating conveyor; a saddle plate disposed on the circulating conveyor which moves the saddle plate vertically upward, the saddle plate arranged to receive the book block in a straddle like fashion with the first and second adhesive-coated outside surfaces being exposed; a pressing-on device that operates synchronously with the circulating conveyor, including: two pressing-on rollers positioned opposite each other in a pressing-on region which each roller presses a respective first or second book cover of the book casing against a respective first or second adhesive-coated outside surface of the book block; first and second drive motors each respectively operatively coupled with the pressing-on device and circulating conveyor; and a drive control unit operatively coupled to the first and second drives, which drive control unit controls the first and second drives and controllably links the first and second drives, at least the first drive including a controllable drive element.

Thus, according to the invention the conveyor and/or the pressing-on device are provided with separate drives, which are controllably connected via a joint control unit. Furthermore, at least the drive for the pressing-on device comprises a controllable drive element, thereby making possible a careful processing during the encasing operation, which results in the production of a high quality book.

An optimum pressing-on operation at a lower pressing-on speed than before is thus possible, in particular for smaller book formats which deviate from the largest book format.

During the pressing-on operation, the movement of the pressing-on device from the starting position must be synchronized with the movement of the conveyor and/or an associated saddle plate, meaning the movements must be coordinated. This section, also called a synchronizing section, starts at the attachment point where the book block spine is still located below the casing support, but at most is level with the casing support, and ends where the book block spine meets the inside of the back insert. That is to say, once the spine and back insert make contact, the movement and/or speed of the saddle plate and the pressing-on device are synchronized.

BRIEF DESCRIPTION OF THE DRAWINGS

These and other features and advantages of the application will be further understood from the following detailed description of the exemplary embodiments with reference to the accompanying drawings, which show in.

DETAILED DESCRIPTION

Figure 1:
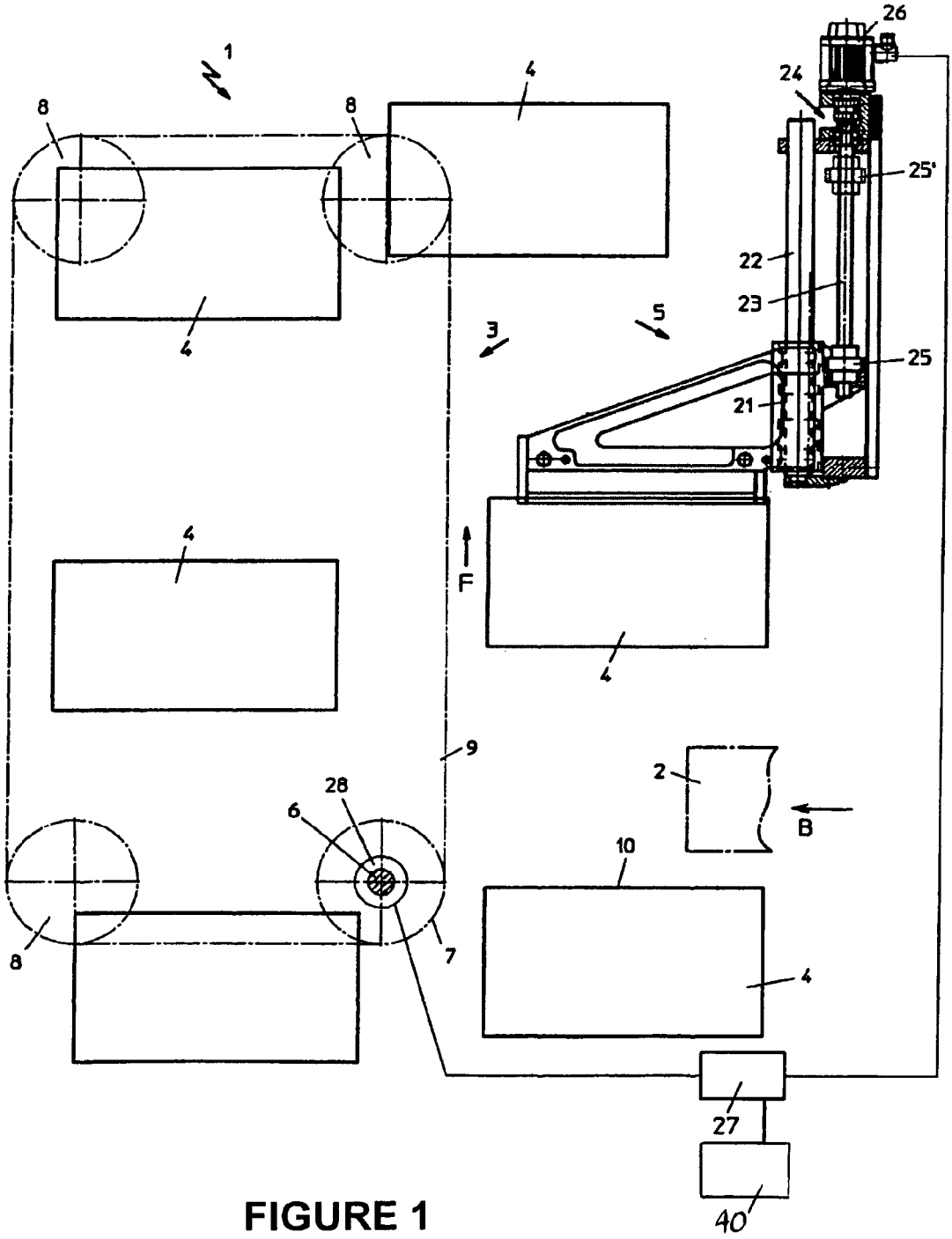
FIG. 1 A schematic representation of the apparatus a book block casing-in machine.
Figure 2:
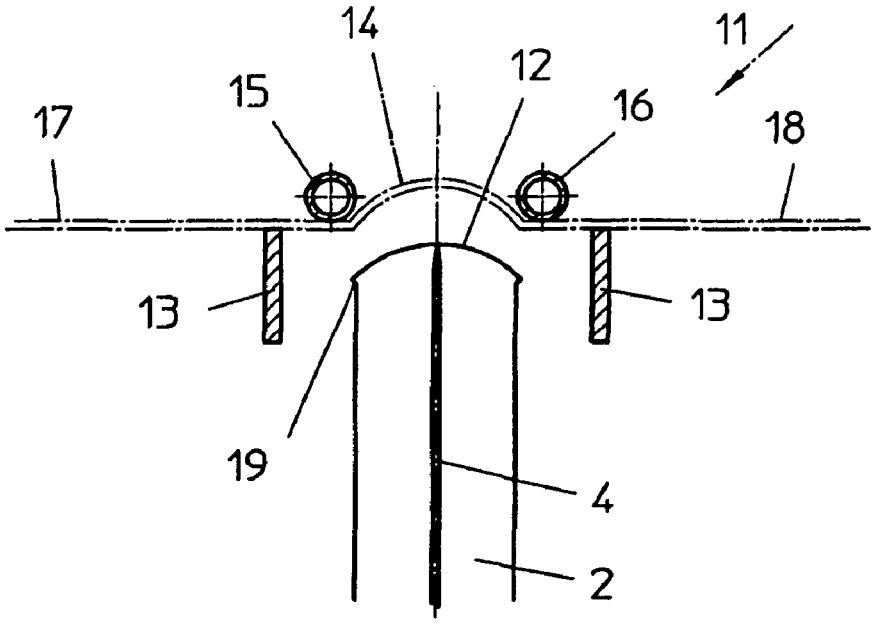
FIG. 2 A schematic representation of the book block and a casing at the start of a pressing-on operation.
Figure 3:
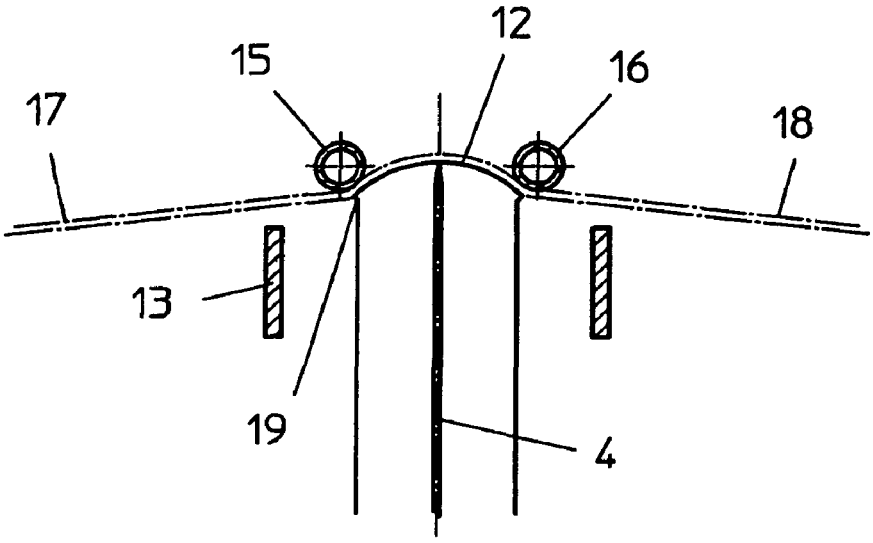
FIG. 3 A schematic representation of the book block and the casing during the pressing-on operation.

FIG. 1 depicts an apparatus 1 for pressing a book casing (shown in FIG. 2) against the adhesive-coated outsides of a book block 2. The book block 2 is conveyed on a saddle plate 4 of a conveyor 3, along a vertical section and through the region of operation for a pressing-on device 5. The conveyor 3 is provided with a drive wheel 7, attached to a drive shaft 6, and three freely rotating deflection wheels 8, around which a traction element 9 circulates, for example a chain or toothed belt. The saddle plates 4, which are attached to the traction element 9, occupy a constant position for each point along the movement path F, with an upper edge 10 of the saddle plate 10 being substantially perpendicular to the vertical movement path F. The book block 2 that is ready for encasing is supplied from the side to the upper edge 10 of the saddle plate 4 and is subsequently positioned straddling on the saddle plate 4. More specifically, the book block 2 is placed on the conveyor 3 in so that the open front edges of the book block 2 point downward as the book block 2 moves in the direction of an arrow B, across a book block divider (not shown herein) which spreads apart the book block 2 in the center. While the book block 2 is positioned in the holding position on the conveyor 3, the saddle plate 4 takes over the book block 2 by dipping from below into the book block 2, which comes to rest straddling on the saddle plate 4. While suspended on the saddle plate 4, the book block 2 initially passes through an adhesive-application region (not shown) where an adhesive applicator applies adhesive to both first and second outside surfaces of the book block. Before the book block 2 with the adhesive applied to the first and second outside surfaces reaches the pressing-on device 5 and/or the pressing on station, arranged above the adhesive applicator, a flattened book casing 11, including first and second book covers 17, 18, is supplied from a side perpendicular to the upward directed movement path of the book block 2. The casing 11 comes to rest evenly spread out across the book block spine 12 and/or the saddle plate 4. This situation is shown in FIG. 2 where the book block 2 with a rounded back spine 12 has just reached an attachment point at the start of a synchronizing section for pressing on a rounded back insert 14 of the book casing 11. The book casing 11 rests on both sides of the saddle plate 4 on a casing support 13. The saddle plates 4 on the conveyor 3, which circulate continuously and with constant speed, bring the book block spines 12 of each book block 2 in contact with an inside surface of the book casing 11, at the rounded or straight back insert 14 (see FIG. 3). During this operation, the pressing-on device 5 here moves with the same speed as the conveyor 3. The spacing between the book block spine 12 and the back insert 14 of the book casing 11 can also be selected such that the book block 2 is inserted more or less into the book casing 11 at the start of the pressing-on operation.

The pressing-on device 5 then reverses to move in the opposite direction, so that the pressing-on rollers 15, 16 pivot the book covers 17, 18 downward, move the book casing 11 across the mushroom-shaped overhang, and press the book covers 17, 18 against the adhesive-coated outside surfaces of the book block 2 with the aid of the press-on rollers 15, 16 which roll off thereon. The pressing-on rollers 15, 16 are spring-supported on the side for this, such that the rollers 15, 16 can move past the mushroom-shaped overhang without being damaged.

Owing to the variable shoulder spacing between the book block spine 12 and a fold 19, caused by the mushroom-shaped squeezing, the movements of the pressing-on device 5 must be adapted to the different cross-sectional shapes in the region of the book block spine.

The same process steps are used for a straight book block spine and/or a book back.

Figure 4:
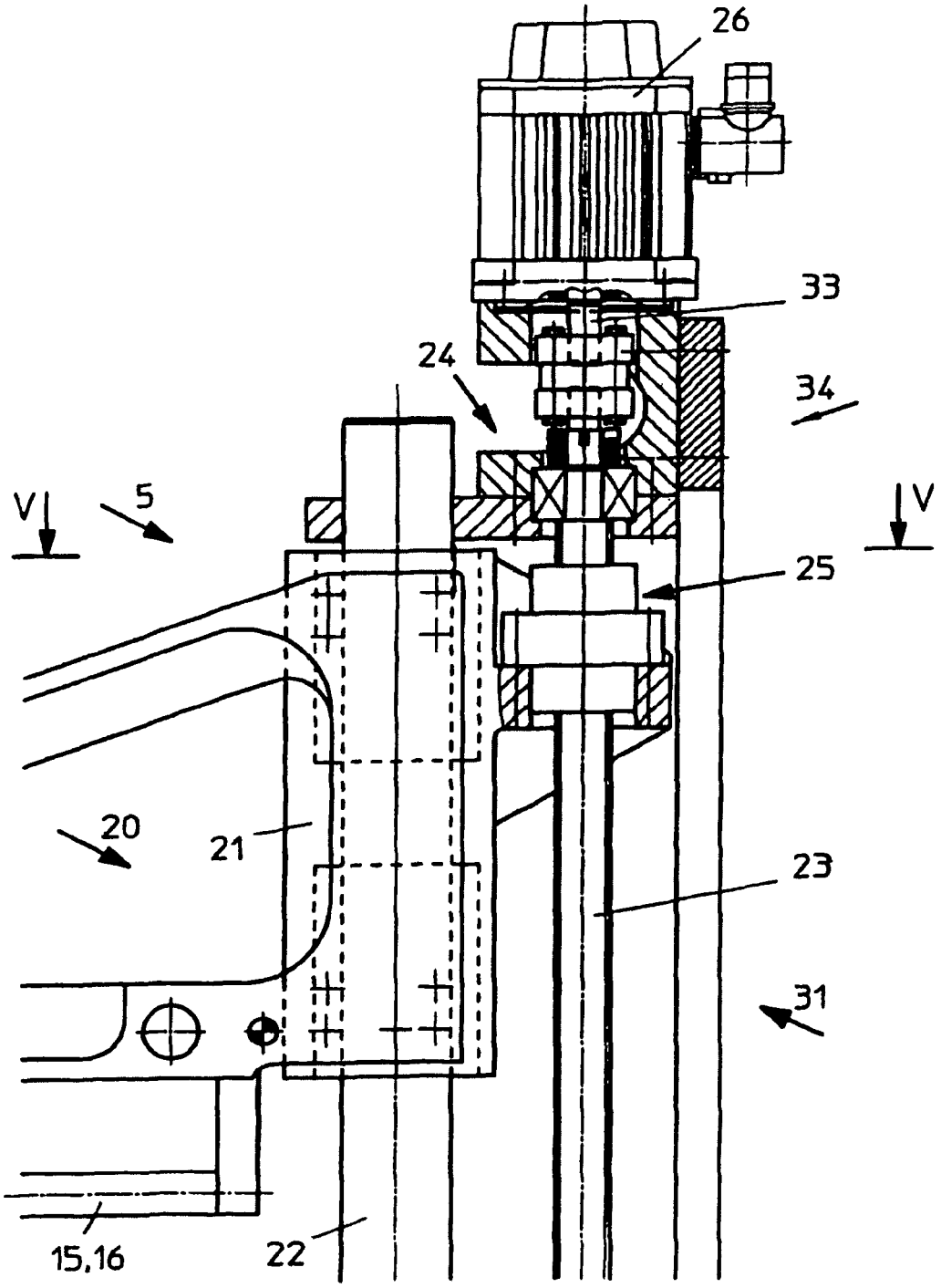
FIG. 4 A partial longitudinal section through a drive unit for the pressing-on device.
Figure 5:
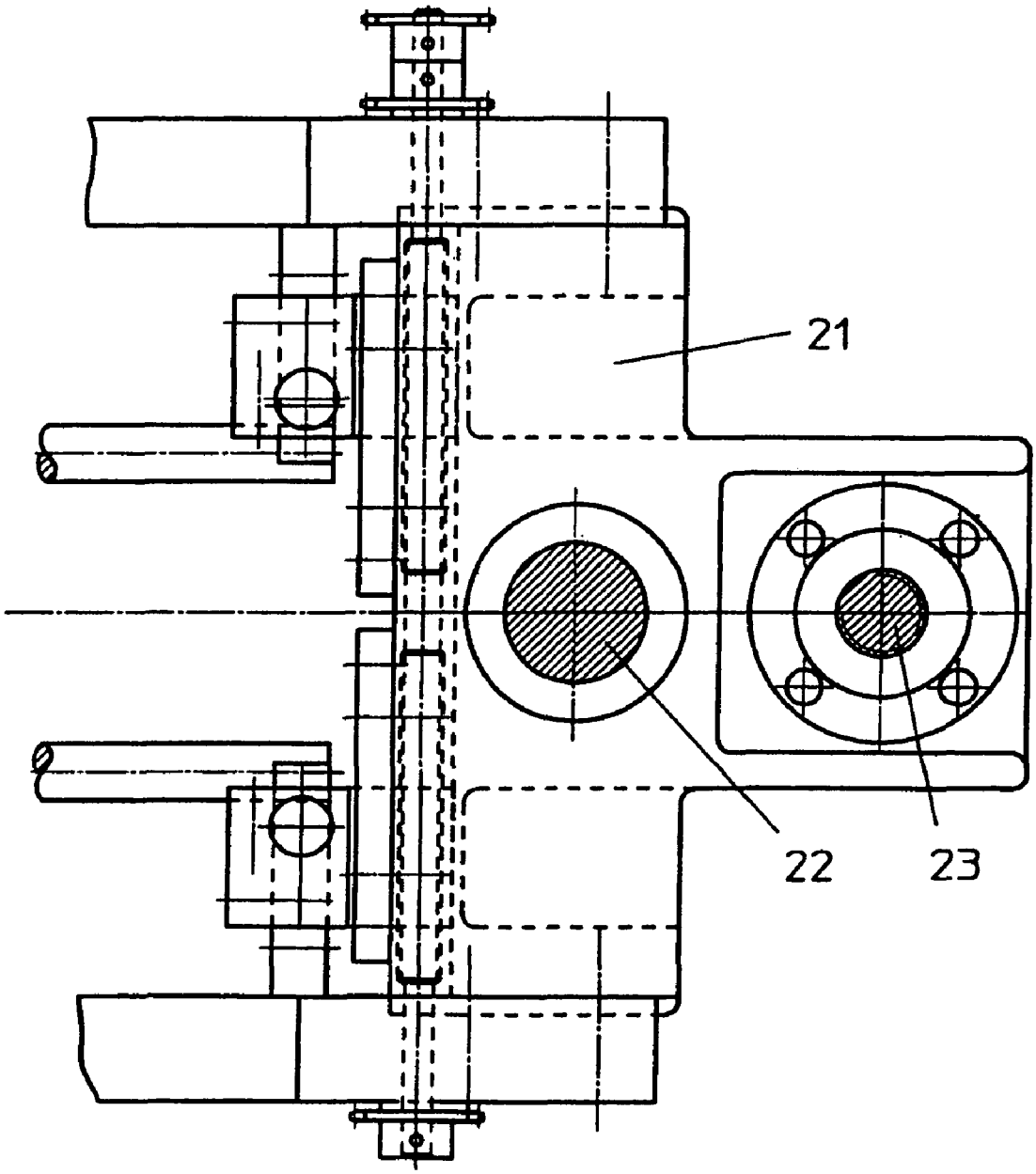
FIG. 5 A view from above of the drive unit shown in FIG. 4.

FIGS. 4 and 5 in connection with FIG. 1 show an option for embodying the drive for a pressing-on device 5, including a guide arrangement 31.

A support frame 20 on which the pressing-on rollers 15, 16 are positioned rotating is provided with a guide bush 21. The support frame 20 can be displaced along the guide bush 21 on guide elements 22, arranged parallel to the vertically upward moving saddle plates 4. A threaded spindle 23 is arranged parallel to the guide elements 22, embodied as rods or the like. The threaded spindle 23 is positioned with an upper end inside a support 24, attached to the guide elements 22, and is connected to the height-adjustable guide bush 21 by a threaded screw 25. The upper end of the threaded spindle 23 is connected to a first drive motor such as an electric motor 26, which is embodied as an angle of rotation-controlled motor and is attached to a control unit 27 (shown in FIG. 1) that also connects a second drive motor 28 of the conveyor 3. FIG. 1 furthermore shows a possible upper position for the support frame 20, resulting from the position of the threaded screw 25'. For a continuous change or adjustment of the relative position between the saddle plates 4 of the conveyor 3 and the starting position and/or the attachment point, as well as with respect to the synchronizing section, the pressing-on device 5 and/or the conveyor 3 are driven with the aid of two separate first and second drive motors 26, 28. The first and second separate drive motors 26, 28 are controllably connected by means of a joint control unit 27, wherein at least the first drive motor 26 of the pressing-on device 5 is embodied as controllable drive element. It is important for the conveyor 3 and/or the saddle plates 4 and the pressing-on device 5 to continue the synchronized movement even after passing through the synchronizing section, until the end of the pressing-on section. As a result, the pressing-on device 5 can be controlled and changes can be effected at least with respect to the synchronizing section.

The pressing-on device 5 can furthermore be controlled and/or variably controlled on the basis of an attachment point for the start of the synchronizing section, which corresponds to the deposited book casing and/or the shape of a book block. It is probably also possible to control and/or variably control the length of a pressing-on movement of the pressing-on device 5 based on a pressing-on section that is determined by a book block and/or a book casing. The pressing-on movement of the pressing-on device 5 can be adjusted or changed manually. The movement of the pressing-on device 5 can also be controlled with a computer program which, for example, might be included with the control unit 27.

Figure 6:
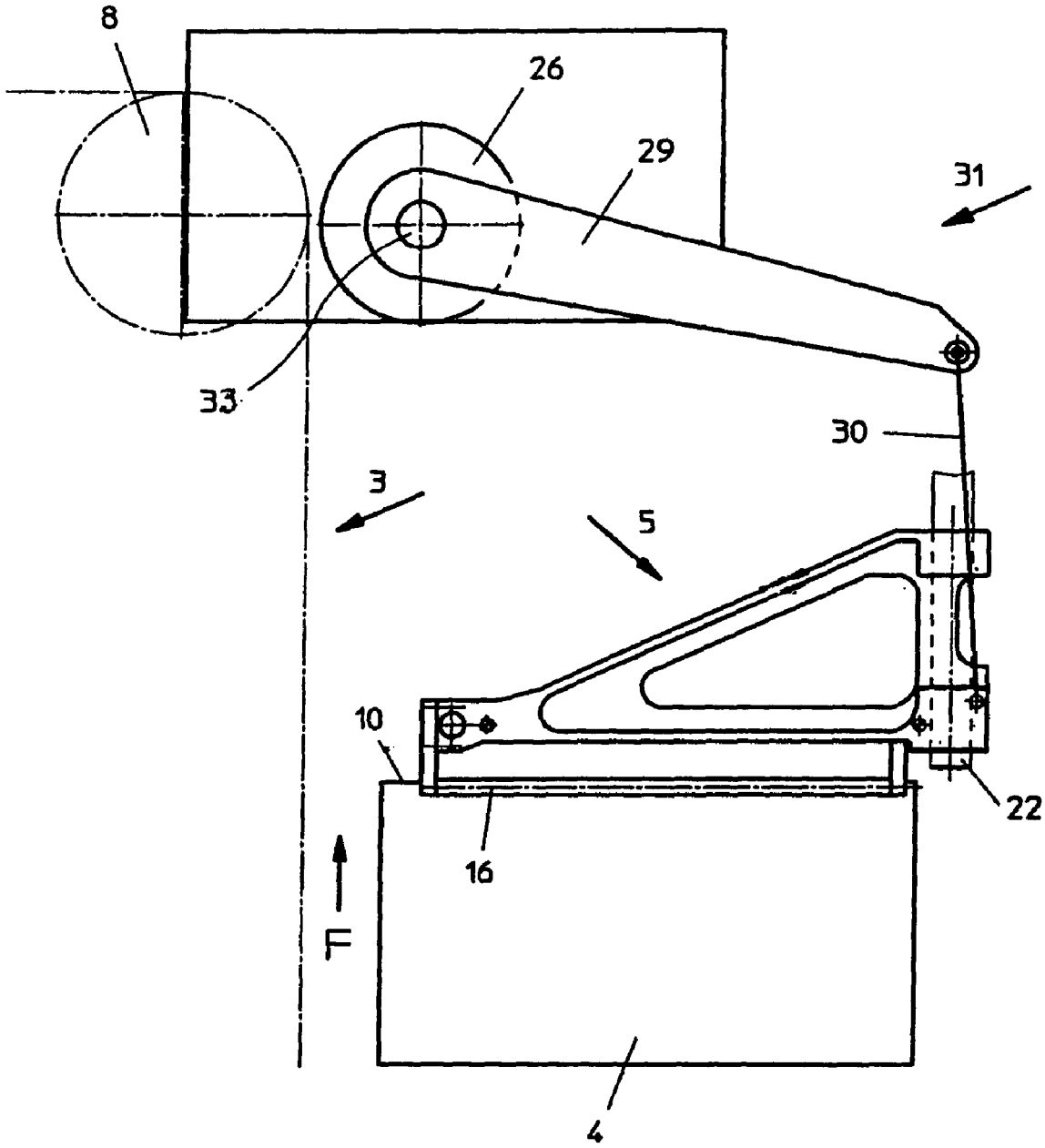
FIG. 6 An alternative drive unit for the pressing-on device.

The pressing-on movement of the pressing-on device 5 can be controlled or variably controlled based on the position of the book block 2 which is conveyed on the conveyor 3. The drive element 26 embodied as an electric motor could be a linear motor or a torque motor, as shown in FIG. 6. A torque motor among other things is designed for high torque and can have precise angle control. A lever 29 is attached to the drive shaft of the torque motor 26 and is connected with its free end via a connecting rod 30 to the pressing-on device 5, which can be displaced along a guide element 22.

The drive element 26 could also be a linear motor mounted on the frame 34 via a drive shaft 33, for which the armature is drive-connected to the pressing-on device 5.

The drive element 26 can be driven program control based on a cam curve, for example, electronically stored in the control unit 27. The cam curve can be embodied variably, for example phase-displaced relative to the upward moving saddle plates 4 on the conveyor 3. The control unit 27 can be connected to a super-imposed machine control unit 40 for the book block casing-in machine.

It will be understood that the above description of the present invention is susceptible to various modifications, changes and adaptations, and the same are intended to be comprehended within the meaning and range of equivalents of the appended claims.

What is claimed is:

1. An apparatus for pressing a flattened book casing including first and second book covers against first and second adhesive-coated outside surfaces of a book block to be encased in a book casing, in a casing-in machine, said apparatus comprising:

a circulating conveyor;

a saddle plate disposed on the circulating conveyor which moves the saddle plate vertically upward, the saddle plate arranged to receive the book block in a straddled position with the first and second adhesive-coated outside surfaces being exposed;

a pressing-on device that is moveable synchronously with the circulating conveyor, including a support frame and two pressing-on rollers positioned opposite each other in a pressing-on region in which each roller presses a respective first or second book cover of the book casing against a respective first or second adhesive-coated outside surface of the book block, wherein the support frame includes a displaceable guide bush;

first and second drive motors each respectively operatively coupled with the pressing-on device and circulating conveyor;

a guide arrangement that moves the pressing-on device upward and downward, comprising:

a drive frame to which the first drive motor is attached so that the first drive motor is drive-connected to the support frame of the pressing-on device, a guide element arranged in parallel to the vertically upward moving saddle plate and coupled to the displaceable guide bush of the support frame, and a threaded spindle arranged in parallel to the guide element, wherein the threaded spindle facilitates movement of the pressing-on device along the guide element, and wherein the threaded spindle is connected to the first drive motor via a drive shaft; and a drive control unit operatively coupled to the first and second drive motors, which drive control unit controls the first and second drive motors and controllably links the first and second drive motors, at least the first drive motor including a controllable drive element.

2. The apparatus according to claim 1, wherein a point of initial contact between the book casing and the book block, positioned on the saddle plate, defines an attachment point, and wherein the pressing-on device is at least one of controlled or variably controlled based on the defined attachment point thereby synchronizing movement with the saddle plate pressing the respective book cover of the book casing against the respective adhesive-coated surface of the book block.

3. The apparatus according to claim 1, wherein the pressing-on region is defined by at least one of the book block or a book cover and wherein a length of a pressing-on movement of the pressing-on device is at least one of controlled or variably controlled, based on the defined pressing-on region.

4. The apparatus according to claim 3, wherein the pressing-on movement of the pressing-on device is adjustable or manually changeable.

5. The apparatus according to claim 3, wherein the pressing-on movement of the pressing-on device is adapted to be controlled by a computer program.

6. The apparatus according to claim 3, wherein the pressing-on movement of the pressing-on device is at least one of controlled or variably controlled based on the position of the book block that is conveyed on the circulating conveyor.

7. The apparatus according to claim 1, wherein the drive element includes an electric motor.

8. The apparatus according to claim 7, wherein the electric motor includes an angle of rotation-controlled motor.

9. The apparatus according to claim 7, wherein the electric motor includes a linear motor.

10. The apparatus according to claim 7, wherein the electric motor includes a torque-controlled motor.

11. The apparatus according to claim 1, further including;

a control program based on a cam curve which control program operates the drive element.

12. The apparatus according to claim 11, wherein the cam curve is changeable.

13. The apparatus according to claim 11, wherein the cam curve is phase-displaceable relative to the saddle plates, which are moved upward by the circulating conveyor.

14. The apparatus according to claim 1, wherein the drive control unit is adapted to be connected to a machine control unit of the book casing-in machine.

15. The apparatus according to claim 1, wherein the guide element includes a guide rod and the guide arrangement includes a threaded screw attached to the guide rod and guide bush through which threaded screw the threaded spindle extends.

16. An apparatus for pressing a flattened book casing including first and second book covers against first and second adhesive-coated outside surfaces of a book block to be encased in a book casing, in a casing-in machine, said apparatus comprising:

a circulating conveyor;

a saddle plate disposed on the circulating conveyor which moves the saddle plate vertically upward, the saddle plate arranged to receive the book block in a straddled position with the first and second adhesive-coated outside surfaces being exposed;

a pressing-on device that is moveable synchronously with the circulating conveyor, including: two pressing-on rollers positioned opposite each other in a pressing-on region in which each roller presses a respective first or second book cover of the book casing against a respective first or second adhesive-coated outside surface of the book block;

first and second drive motors each respectively operatively coupled with the pressing-on device and circulating conveyor; and a drive control unit operatively coupled to the first and second drive motors, which drive control unit controls the first and second drive motors and controllably links the first and second drive motors, at least the first drive motor including a controllable drive element, wherein the drive element includes a torque motor and further includes a lever which is directly attached to the drive element via a drive shaft and to the support frame of the pressing-on device via a connecting rod.

17. The apparatus according to claim 1, wherein the drive element includes a linear motor.

18. The apparatus according to claim 1, wherein the threaded spindle is positioned with an upper end inside a support, attached to the guide element, and is connected to the displaceable guide bush by a threaded screw.

19. The apparatus according to claim 1, wherein an upper end of the threaded spindle is connected to the first drive motor.

* * * * *